US012281377B2

(12) United States Patent
Kasuya et al.

(10) Patent No.: US 12,281,377 B2
(45) **Date of Patent: *Apr. 22, 2025**

(54) COPPER ALLOY AND METHOD FOR PRODUCING SAME

(71) Applicant: NGK INSULATORS, LTD., Nagoya (JP)

(72) Inventors: Yumiko Kasuya, Handa (JP); Koki Chiba, Handa (JP)

(73) Assignee: NGK INSULATORS, LTD., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/656,028

(22) Filed: Mar. 23, 2022

(65) Prior Publication Data

US 2022/0316029 A1 Oct. 6, 2022

(30) Foreign Application Priority Data

Mar. 31, 2021 (JP) ..... 2021-059496
Jan. 12, 2022 (JP) ..... 2022-003397

(51) Int. Cl.
*C22C 9/06* (2006.01)
*C22C 1/02* (2006.01)
*C22F 1/08* (2006.01)

(52) U.S. Cl.
CPC ..... *C22C 9/06* (2013.01); *C22C 1/02* (2013.01); *C22F 1/08* (2013.01)

(58) Field of Classification Search
CPC ..... C22C 1/02; C22C 9/06; C22C 9/02; C22F 1/08
USPC ..... 420/473
See application file for complete search history.

(56) References Cited

U.S. PATENT DOCUMENTS 11,035,024 B2 6/2021 Weber
2007/0253858 A1 11/2007 Ababneh et al.
2016/0130685 A1* 5/2016 Huang ..... B22F 3/12 419/10

(Continued)

FOREIGN PATENT DOCUMENTS

CN 106834795 A 6/2017
EP 3 085 798 A1 10/2016

(Continued)

OTHER PUBLICATIONS

NPL: on-line translation of WO-2020115932-A1, Jun. 2020 (Year: 2020).*

(Continued)

*Primary Examiner* — Jie Yang
(74) *Attorney, Agent, or Firm* — BURR PATENT LAW, PLLC

(57) ABSTRACT

There is provided a copper alloy composed of Ni: 5 to 25% by weight, Sn: 5 to 10% by weight, at least one element M selected from the group consisting of Zr, Ti, Fe, and Si: 0.01 to 0.30% by weight in total, at least one element A selected from the group consisting of Mn, Zn, Mg, Ca, Al, and P: 0.01 to 1.00% by weight in total, the balance being Cu and inevitable impurities. Ni-based intermetallic compound grains containing a Ni-M intermetallic compound are formed in the copper alloy. The number of the Ni-based intermetallic compound grains present per unit area of 1 $mm^2$ in the copper alloy is $1.0\times10^3$ to $1.0\times10^6$.

9 Claims, 4 Drawing Sheets

(56) References Cited

U.S. PATENT DOCUMENTS

| | | | | |
|---|---|---|---|---|
| 2019/0099843 | A1 | 4/2019 | Aoshima | |
| 2022/0389541 | A1 * | 12/2022 | Takeuchi | C22C 9/06 |

FOREIGN PATENT DOCUMENTS

| | | | | |
|---|---|---|---|---|
| EP | 3 085 799 | A1 | | 10/2016 |
| JP | H08-283889 | A | | 10/1996 |
| JP | 2017-179538 | A | | 10/2017 |
| JP | 2018-003125 | A | | 1/2018 |
| JP | 2019137913 | A | * | 8/2019 |
| JP | 2019-524984 | A | | 9/2019 |
| WO | 2018/110037 | A1 | | 6/2018 |
| WO | WO-2020115932 | A1 | * | 6/2020 |

OTHER PUBLICATIONS

NPL: on-line translation of JP-2019137913-A, Aug. 2019 (Year: 2019).*

Extended European Search Report dated Aug. 31, 2022 (Application No. 22164760.5).

Chinese Office Action dated May 20, 2023 (Application No. 202210293940.9).

* cited by examiner

COPPER ALLOY AND METHOD FOR PRODUCING SAME

CROSS-REFERENCE TO RELATED APPLICATIONS

This application claims priority to Japanese Patent Application No. 2021-059496 filed Mar. 31, 2021 and Japanese Patent Application No. 2022-003397 filed Jan. 12, 2022, the entire contents all of which are incorporated herein by reference.

BACKGROUND OF THE INVENTION

1. Field of the Invention

The present invention relates to a copper alloy and a method for producing the same.

2. Description of the Related Art

Conventionally, materials having wear resistance have been used in various fields, such as automobiles, construction machines, agricultural machines, and marine vessels. The materials having wear resistance are often used as a sliding component (slide bearing), such as a bearing, a piston bush, or a metal bush, and for example, those materials made of a Cu—Ni—Sn alloy, a high strength brass, kelmet, or the like are known.

Various alloys as described above are selected as a material having wear resistance according to the condition, such as load or rotational speed, of the location of use. For example, Patent Literature 1 (JPH8-283889A) discloses, as a material made of a Cu—Ni—Sn alloy, a high-strength/high-hardness copper alloy comprising Ni: 5 to 20%, Sn: 3 to 15%, and Mn: 0.5 to 5% in terms of % by weight, the balance being Cu and inevitable impurities. The literature discloses that a hard intermetallic compound crystallizes out in the matrix of this copper alloy to contribute to improvements in wear resistance and seizure resistance. In addition, Patent Literature 2 (Japanese Translation of PCT International Application Publication No. 2019-524984) discloses a high-strength Cu—Ni—Sn alloy comprising Ni: 2.0 to 10.0%, Sn: 2.0 to 10.0%, Si: 0.01 to 1.5%, B: 0.002 to 0.45%, P: 0.001 to 0.09% (in terms of % by weight), and a predetermined metal element as an optional component, the balance being Cu and inevitable impurities.

CITATION LIST

Patent Literature

Patent Literature 1: JPH8-283889A
Patent Literature 2: JP2019-524984A

SUMMARY OF THE INVENTION

As described above, wear-resistant materials made of a Cu—Ni—Sn alloy have been investigated; however, further improvements in wear resistance have been desired.

The present inventors have found that a copper alloy having a predetermined composition, in which Ni-based intermetallic compound grains are formed, is superior in wear resistance.

Accordingly, an object of the invention is to produce or provide a copper alloy superior in wear resistance.

According to an aspect of the present invention, there is provided a copper alloy composed of:

Ni: 5 to 25% by weight;

Sn: 5 to 10% by weight;

at least one element M selected from the group consisting of Zr, Ti, Fe, and Si: 0.01 to 0.30% by weight in total;

at least one element A selected from the group consisting of Mn, Zn, Mg, Ca, Al, and P: 0.01 to 1.00% by weight in total;

the balance being Cu and inevitable impurities, wherein Ni-based intermetallic compound grains comprising a Ni-M intermetallic compound are formed in the copper alloy, and the number of the Ni-based intermetallic compound grains present per unit area of 1 $mm^2$ in the copper alloy is $1.0\times10^3$ to $1.0\times10^6$.

According to another aspect of the present invention, there is provided a method for producing the copper alloy, the method comprising:

melting and casting a raw material alloy to make an ingot, the raw material alloy composed of:

Ni: 5 to 25% by weight;

Sn: 5 to 10% by weight;

at least one element M selected from the group consisting of Zr, Ti, Fe, and Si: 0.01 to 0.30% by weight in total; and at least one element A selected from the group consisting of Mn, Zn, Mg, Ca, Al, and P: 0.01 to 1.00% by weight in total;

the balance being Cu and inevitable impurities, subjecting the ingot to hot working or cold working to make an intermediate product, performing i) a heat treatment, ii) hot working or cold working, and iii) solutionization on the intermediate product in this order, thereby performing a thermomechanical treatment, and subjecting the intermediate product after the thermomechanical treatment to an aging treatment to obtain the copper alloy.

DETAILED DESCRIPTION OF THE INVENTION

Copper Alloy

Figure 1:
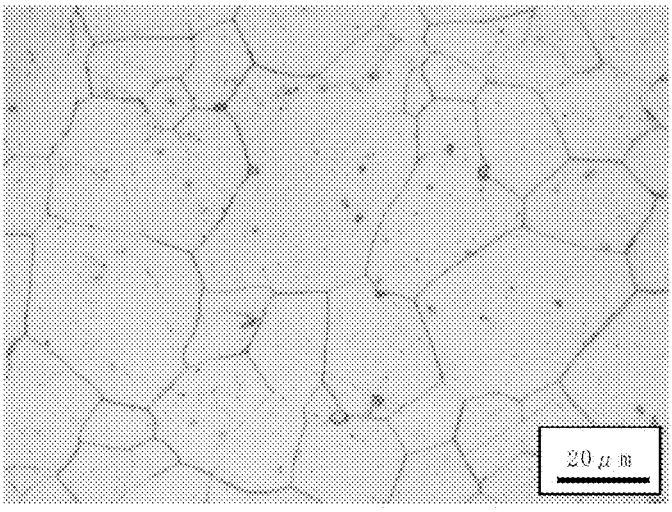
FIG. 1 is an electron microscope observation image of a cross section of a copper alloy obtained in Example 1.

A copper alloy according to the present invention is composed of Ni: 5 to 25% by weight, Sn: 5 to 10% by weight, at least one element M selected from the group consisting of Zr, Ti, Fe, and Si: 0.01 to 0.30% by weight in total, at least one element A selected from the group consisting of Mn, Zn, Mg, Ca, Al, and P: 0.01 to 1.00% by weight in total, the balance being Cu and inevitable impurities. In addition, Ni-based intermetallic compound grains containing a Ni-M intermetallic compound are formed in this copper alloy. Further, the number of the Ni-based intermetallic compound grains present per unit area of 1 $mm^2$ in the copper alloy is $1.0\times10^3$ to $1.0\times10^6$. Such a copper alloy is superior in wear resistance. As described above, wear-resistant materials made of a Cu—Ni—Sn alloy have been investigated in the past, but further improvements in wear resistance have been desired. Meanwhile, according to the present invention, a copper alloy superior in wear resistance can be provided.

The copper alloy of the present invention preferably has a friction coefficient of 0.4 or less, more preferably has a friction coefficient of 0.35 or less, and still more preferably has a friction coefficient of 0.3 or less. Such a copper alloy superior in wear resistance is used for a sliding component, such as, for example, a slide bearing, but the intended use is not particularly limited as long as wear resistance is required for the intended use.

The copper alloy of the present invention is composed of Ni: 5 to 25% by weight, Sn: 5 to 10% by weight, at least one element M selected from the group consisting of Zr, Ti, Fe, and Si: 0.01 to 0.30% by weight in total, at least one element A selected from the group consisting of Mn, Zn, Mg, Ca, Al, and P: 0.01 to 1.00% by weight in total, the balance being Cu and inevitable impurities. Preferably, this copper alloy is composed of Ni: 8.5 to 9.5% by weight, Sn: 5.5 to 6.5% by weight, Zr: 0.0 to 0.2% by weight, Ti: 0.0 to 0.2% by weight, Fe: 0.0 to 0.2% by weight, Si: 0.0 to 0.2% by weight, Mn: 0.2 to 0.9% by weight, Zn: 0.0 to 0.2% by weight, the balance being Cu and inevitable impurities (however, contains at least one of Zr, Ti, Fe, and Si within a range of 0.01 to 0.30% by weight in total), or is composed of Ni: 20.0 to 22.0% by weight, Sn: 4.5 to 5.7% by weight, Zr: 0.0 to 0.2% by weight, Ti: 0.0 to 0.2% by weight, Fe: 0.0 to 0.2% by weight, Si: 0.0 to 0.2% by weight, Mn: 0.2 to 0.9% by weight, Zn: 0.0 to 0.2% by weight, the balance being Cu and inevitable impurities (however, contains at least one of Zr, Ti, Fe, and Si within a range of 0.01 to 0.30% by weight in total).

The crystal grain size of the copper alloy of the present invention is preferably 1.0 to 100 μm, and more preferably 1.0 to 20 μm. By setting the crystal grain size to this range, the ductility of the copper alloy is further improved, the elongation can be secured, and the bendability can be improved.

The element M is at least one element selected from Zr, Ti, Fe, and Si. The element M, together with Ni, composes the Ni-M intermetallic compound and contributes to formation of the Ni-based intermetallic compound grains containing the element M. It is considered that the Ni-based intermetallic compound grains are formed in the copper alloy and function as if they were rollers in a bearing, and, as a result, contribute to an improvement in the wear resistance of the copper alloy. Examples of the Ni-M intermetallic compound include a Ni—Zr intermetallic compound, a Ni—Ti intermetallic compound, a Ni—Fe intermetallic compound, and a Ni—Si intermetallic compound. The element M preferably contains at least Zr, and is more preferably Zr. Accordingly, the Ni-M intermetallic compound is preferably a Ni—Zr intermetallic compound. Zr forms a Ni-based intermetallic compound having the optimal hardness between a copper alloy and a mating material (for example, carbon steels, such as JIS G 4805: SUJ2 (high carbon chromium bearing steels) which is in contact with the copper alloy, and therefore an effect on the improvement in wear resistance is further expected. As described above, not only Zr but also any of Ti, Fe, and Si forms a Ni-M intermetallic compound; however, Zr, rather than Ti, Fe, and Si, is preferably contained in the copper alloy also from the viewpoint of rollability during production of the copper alloy. That is, with the element M being Zr, both of the wear resistance and the rollability can be realized effectively.

Since Sn in addition to the element M is also contained in the copper alloy of the present invention, a Ni—Sn intermetallic compound (for example, $Ni_2Sn_3$ and $Ni_3Sn$) in addition to the Ni-M intermetallic compound can also be formed as the Ni-based intermetallic compound grains. Thus, the Ni-based intermetallic compound grains preferably contain a Ni-M intermetallic compound and a Ni—Sn intermetallic compound, and is more preferably composed of a Ni-M intermetallic compound and a Ni—Sn intermetallic compound. Technically, there is a possibility that the proportion of the number of grains to be formed in the copper alloy is larger for the Ni—Sn intermetallic compound grains than for the Ni-M intermetallic compound grains, but only increasing the number of the Ni—Sn intermetallic compound grains is not sufficient for the effect of wear resistance. On the other hand, the number of the Ni-M intermetallic compound grains tends to be smaller than the number of the Ni—Sn intermetallic compound grains, but by forming the Ni-M intermetallic compound in the copper alloy, a further improvement in wear resistance can be expected. The Ni—Sn intermetallic compound can also contribute to an improvement in wear resistance to some extent (although the extent is less than the that in the case of the Ni-M intermetallic compound), and therefore a larger amount of the Ni—Sn intermetallic compound can be formed by, for example, adjusting a heat treatment condition in the process of producing the copper alloy. From these, the copper alloy of the present invention has characteristics that a larger amount of the Ni-based intermetallic compound grains is formed in the copper alloy of the present invention than in conventional copper alloys and the Ni-based intermetallic compound grains contain a Ni-M intermetallic compound.

The proportion of the number of the Ni-M intermetallic compound grains having a grain size of 0.1 μm or larger in the total number of the Ni-based intermetallic compound grains formed in the copper alloy and having a grain size of 0.1 μm or larger is preferably 1.0 to 30%, and more preferably 1.0 to 15% from the viewpoints of improving wear resistance and rollability. Note that the measurement method for determining the proportion of the number of the Ni-M intermetallic compound grains is not particularly limited, but is preferably a method using compositional analysis by, for example, SEM-EDX (Energy Dispersive X-ray spectroscopy). In this case, the proportion of the number of the Ni-M intermetallic compound grains can be determined according to the following procedure. Firstly, a cross section of the copper alloy is polished and then etched to allow a cross-sectional structure to appear. For each of arbitrarily selected five points in the cross section, a photograph is taken at a magnification of 1000 times to perform elemental analysis by SEM-EDX (Energy Dispersive X-ray spectroscopy). In a region of a diameter of 60 mm (area 2826 $mm^2$) on each of the photographs and element mapping images taken, the number of the Ni-based intermetallic compound grains (including the Ni-M intermetallic compound grains) interspersed in crystal grain boundaries and crystal grains and the number of the Ni-M intermetallic compound grains interspersed in crystal grain boundaries and crystal grains are measured. On this occasion, only the grains having a grain size of 0.1 μm or larger are counted as the Ni-based intermetallic compound grains (including the Ni-M intermetallic compound grains). By dividing the number of the Ni-M intermetallic compound grains by the number of the Ni-based intermetallic compound grains and multiplying the quotient by 100, the proportion (%) of the number of the Ni-M intermetallic compound grains to the number of the Ni-based intermetallic compound grains is calculated. The average value of the values obtained in each of the photographs and element mapping images of the five points is desirably adopted as a representative value of the copper alloy.

The total content of the element M is 0.01 to 0.30% by weight. This content is preferably 0.01 to 0.20% by weight. With this content being 0.30% by weight or less, coarsening of the Ni-based intermetallic compound grains can be suppressed, and the Ni-based intermetallic compound grains can be micronized, so that the castability and the rollability can be improved. With this content being 0.01% by weight or more, the grain size and the number of grains of the Ni-based intermetallic compound grains can be controlled, so that the wear resistance and the hot rollability can be improved.

The Ni-based intermetallic compound grains formed in the copper alloy of the present invention preferably has a grain size of 0.1 to 100 μm, more preferably has a grain size of 1.0 to 20 μm, and still more preferably has a grain size of 1.0 to 10 μm. In addition, the number of the Ni-based intermetallic compound grains present per unit area of 1 $mm^2$ in the copper alloy is $1.0\times10^3$ to $1.0\times10^6$, preferably $1.0\times10^3$ to $1.0\times10^5$, and more preferably $1.0\times10^4$ to $1.0\times10^5$. The methods of measuring and calculating the grain size and the number of grains of the Ni-based intermetallic compound grains are not particularly limited, but the grains having a grain size of 0.1 μm or larger are preferably counted as the Ni-based intermetallic compound grains.

The element A is at least one element selected from Mn, Zn, Mg, Ca, Al, and P. With the copper alloy of the present invention containing the element A, the element A dissolves in the raw material alloy during production of the copper alloy, so that an effect of deoxidizing the molten alloy, and an effect of preventing coarsening of the crystal grains in the parent phase during a solution heat treatment can be expected. The element A preferably contains at least Mn, and is more preferably Mn.

The total content of the element A is 0.01 to 1.00% by weight. This content is preferably 0.10 to 0.40% by weight, and more preferably 0.15 to 0.30% by weight. With this content being 0.01% by weight or more, the above-described effects, which are obtained when the copper alloy contains the element A, can be expected further. With this content being 1.00% by weight or less, the above-described effects, which are obtained when the copper alloy contains the element A, can be expected further, but it is considered that a further effect cannot be expected even if the element A in an amount exceeding 1.00% by weight is added. In addition, when Mn is contained as the element A in the copper alloy, the content of Mn is preferably set to 0.10 to 0.40% by weight. Thus, coarsening of crystal grains can be suppressed, so that bending workability can be improved.

Inevitable impurities are contained in the copper alloy of the present invention, and examples of the inevitable impurity include B. The content of B in the copper alloy is typically 0% by weight or extremely close to 0% by weight.

Method for Producing Copper Alloy

A method for producing the copper alloy according to the present invention preferably includes the steps of (a) melting and casting a raw material alloy to make an ingot, the raw material alloy being composed of Ni: 5 to 25% by weight, Sn: 5 to 10% by weight, at least one element M selected from the group consisting of Zr, Ti, Fe, and Si: 0.01 to 0.30% by weight in total, at least one element A selected from the group consisting of Mn, Zn, Mg, Ca, Al, and P: 0.01 to 1.00% by weight in total, the balance being Cu and inevitable impurities, (b) subjecting the ingot to hot working or cold working to make an intermediate product, (c) performing i) a heat treatment, ii) hot working or cold working, and iii) solutionization on the intermediate product in this order, thereby performing a thermomechanical treatment, and (d) subjecting the intermediate product after the thermomechanical treatment to an aging treatment to thereby obtain the copper alloy. Thereby, the copper alloy, as described above, which is superior in wear resistance can be produced. Preferred aspects of the copper alloy are as described above, and therefore the description on the preferred aspects is omitted here.

(a) Melting and Casting Raw Material Alloy

Firstly, a raw material alloy is provided. The raw material alloy is preferably composed of Ni: 5 to 25% by weight, Sn:5 to 10% by weight, at least one element M selected from the group consisting of Zr, Ti, Fe, and Si: 0.01 to 0.30% by weight in total, at least one element A selected from the group consisting of Mn, Zn, Mg, Ca, Al, and P: 0.01 to 1.00% by weight in total, the balance being Cu and inevitable impurities. More preferably, this raw material alloy is composed of Ni: 8.5 to 9.5% by weight, Sn: 5.5 to 6.5% by weight, Zr: 0.0 to 0.2% by weight, Ti:0.0 to 0.2% by weight, Fe: 0.0 to 0.2% by weight, Si:0.0 to 0.2% by weight, Mn: 0.2 to 0.9% by weight, Zn: 0.0 to 0.2% by weight, the balance being Cu and inevitable impurities (however, contains at least one of Zr, Ti, Fe, and Si within a range of 0.01 to 0.30% by weight in total), or is composed of Ni: 20.0 to 22.0% by weight, Sn: 4.5 to 5.7% by weight, Zr: 0.0 to 0.2% by weight, Ti: 0.0 to 0.2% by weight, Fe: 0.0 to 0.2% by weight, Si: 0.0 to 0.2% by weight, Mn: 0.2 to 0.9% by weight, Zn: 0.0 to 0.2% by weight, the balance being Cu and inevitable impurities (however, contains at least one of Zr, Ti, Fe, and Si within a range of 0.01 to 0.30% by weight in total). The element M preferably contains at least Zr, and is more preferably Zr. The element A preferably contains Mn, and is more preferably Mn. Preferred contents of the element M and the element A are the same as described above on the copper alloy.

In this step, the provided raw material alloy is melted and cast to make an ingot. The raw material alloy is preferably melted in, for example, a high-frequency melting furnace. The casting method is not particularly limited, and a continuous casting method, a semi-continuous casting method, a batch casting method, or the like may be used. In addition, a horizontal casting method, a vertical casting method, or the like may be used. The shape of the obtained ingot may be, for example, a slab, a billet, a bloom, a plate, a rod, a tube, a block, or the like, but the shape is not particularly limited, and therefore may be any of the shapes other than these.

(b) Hot Working or Cold Working on Ingot

The obtained ingot is subjected to hot working or cold working to make an intermediate product. Examples of the working method include casting, rolling, extruding, and drawing. In this step, the ingot is preferably subjected to hot working or cold working to perform rough rolling to thereby obtain a rolled material (the intermediate product).

(c) Thermomechanical Treatment i) A heat treatment, ii) hot working or cold working, and iii) solutionization are performed on the obtained intermediate product in this order, thereby performing a thermomechanical treatment.

In the step of performing the thermomechanical treatment, the heat treatment is first performed on the intermediate product. In this heat treatment, the intermediate product is preferably held at 500 to 950° C. for 2 to 24 hours. The heat treatment temperature is more preferably 600 to 800° C., and still more preferably 650 to 750° C. The holding time at the temperature is more preferably 2 to 12 hours, and still more preferably 5 to 10 hours. Thus, the Ni-based intermetallic compound grains can be dispersed as micronized products in the copper alloy as intended, and the grain size of the Ni-based intermetallic compound grains and the number of the Ni-based intermetallic compound grains present per unit area of 1 $mm^2$ in the copper alloy can be controlled as described above.

After the heat treatment is performed on the intermediate product, the hot working or the cold working is performed. A method similar to the method in (b) may be used as a working method. For example, when rolling is performed on the intermediate product to shape the intermediate product into a platy shape, the rolling is preferably performed in such a way that the processing rate, specified by the following equation: $P=100\times(T-t)/T$, wherein P represents the processing rate (%), T represents the plate thickness (mm) of the intermediate product before the rolling, and t represents the plate thickness (mm) of the intermediate product after the rolling, is 0 to 95%.

A solution annealing is performed on the intermediate product after the hot working or the cold working. In this treatment, the intermediate product is preferably held at 700 to 1000° C. for 5 seconds to 24 hours. The solution annealing temperature is more preferably 750 to 950° C., and still more preferably 800 to 900° C. The holding time at the temperature is more preferably 1 minute to 5 hours, and still more preferably 1 to 5 hours. The intermediate product is preferably quenched after the solution annealing. The cooling method is not particularly limited, and examples thereof include water cooling, oil cooling, and air cooling. The temperature decreasing rate by this cooling is preferably 20° C./s or more, and more preferably 50° C./s or more. When a copper alloy containing Ni: around 9.0% by weight, Sn: around 6.0% by weight, the balance being Cu and inevitable impurities, or a copper alloy having a composition close to this composition (for example, a copper alloy further containing Zr or Mn), or a copper alloy containing Ni: around 21.0% by weight, Sn: around 5.0% by weight, the balance being Cu and inevitable impurities, or a copper alloy having a composition close to this composition (for example, a copper alloy further containing Zr or Mn) is used as the raw material alloy, the intermediate product is preferably held at 750 to 850° C. for 5 to 500 seconds, and is more preferably held at 750 to 850° C. for 30 to 240 seconds. In addition, these intermediate products are preferably water-cooled immediately after the solution annealing.

(d) Aging Treatment on Intermediate Product

The intermediate product after the thermomechanical treatment is subjected to an aging treatment to thereby obtain a copper alloy. By the aging treatment, the strength of the copper alloy to be obtained can be enhanced. The aging treatment temperature is preferably 300 to 500° C., and more preferably 350 to 450° C. The holding time at the temperature is preferably 1 to 24 hours, and more preferably 2 to 12 hours.

A copper alloy superior in wear resistance can preferably be produced through the steps of (a) to (d).

Further, the intermediate product may be subjected to finishing hot working or finishing cold working after the thermomechanical treatment of (c) and before the aging treatment of (d). That is, a step of subjecting the intermediate product to finish hot working or finish cold working is preferably further included after the thermomechanical treatment and before the aging treatment. For example, by performing finish rolling using finish cold working on the intermediate product after the thermomechanical treatment and before the aging treatment, the plate thickness of the intermediate product can be made into a target plate thickness.

EXAMPLES

The present invention will be described more specifically with reference to the following Examples.

Example 1

A copper alloy was prepared and evaluated according to the following procedures.

(1) Melting and Casting of Raw Material Alloy

A raw material alloy (Ni: 8.5 to 9.5% by weight, Sn: 5.5 to 6.5% by weight, Zr: 0.14% by weight, Mn: 0.35% by weight, the balance being Cu and inevitable impurities) was provided. This raw material alloy was melted in a high-frequency melting furnace and cast by a vertical casting method to obtain a round-shaped ingot having a diameter of 320 mm.

(2) Hot Working or Cold Working on Ingot

A soaking treatment was performed on the obtained ingot to perform hot working and cold working to thereby obtain an intermediate product.

(3) Thermomechanical Treatment

A heat treatment was performed on the obtained intermediate product. Specifically, the intermediate product was held at 730° C. for 6 hours to form Ni-based intermetallic compound grains in the intermediate product. Subsequently, this intermediate product was rolled by performing cold working on the intermediate product in such a way that the processing rate was 50%, thereby shaping the intermediate product into a platy shape. Further, this intermediate product was heated at 820° C. for 60 seconds to be solutionized, and immediately after that, the intermediate product was quenched by water cooling at a temperature decreasing rate of 20° C./s. In this way, the intermediate product was subjected to the thermomechanical treatment.

(4) Finish Hot Working or Finish Cold Working on Intermediate Product

The intermediate product on which the thermomechanical treatment was performed was subjected to cold rolling (finish rolling) to make the thickness of the intermediate product 1.5 mm.

(5) Aging Treatment on Intermediate Product

The intermediate product on which the finish rolling was performed was subjected to an aging treatment by holding the intermediate product at 375° C. for 2 hours to thereby obtain a copper alloy.

(6) Evaluation

The following evaluations were performed on the obtained copper alloy.

<Cross-Section Observation>

A cross section of the copper alloy obtained in (5) was polished and then etched, and the cross section was observed with an electron microscope at a magnification of 1000 times. The result is shown in FIG. 1. In FIG. 1, the black points show the Ni-based intermetallic compound grains, and it was found that a large number of the Ni-based intermetallic compound grains were formed in a dispersed manner.

Further, the grain size of Ni-based intermetallic compound grains and the number of Ni-based intermetallic compound grains present per unit area of 1 $mm^2$ in the copper alloy were measured for the Ni-based intermetallic compound grains formed in this copper alloy. Specifically, those were measured by the following methods. The cross section of the copper alloy was polished and then etched to allow the cross-section structure to appear. Each of arbitrarily selected ten points in the cross section was photographed with an electron microscope at a magnification of 1000 times. In a region of 82 mm in length and 118 mm in width (area 9676 $mm^2$) on each photograph taken, the dimensions and number of the Ni-based intermetallic compound grains interspersed in crystal grain boundaries and crystal grains were measured. On that occasion, only the grains having a grain size of 0.1 μm or larger were counted as the Ni-based intermetallic compound grains. In each photograph, the number of the Ni-based intermetallic compound grains was converted into the number of the grains per unit area of 1 $mm^2$. The arithmetic average of the number of the Ni-based intermetallic compound grains per unit area of 1 $mm^2$ was taken in these ten points to determine the number of the Ni-based intermetallic compound grains present per unit area of 1 $mm^2$ in the copper alloy. As a result, the number of the Ni-based intermetallic compound grains present per unit area of 1 $mm^2$ in the copper alloy was $2.0\times10^4$. Further, the dimensions of the length and width of each of the Ni-based intermetallic compound grains seen in each photograph were measured to calculate the total of the lengthwise dimension and the total of the crosswise dimension of the Ni-based intermetallic compound grains seen in all of the ten photographs. By dividing each of the total of the lengthwise dimension and the total of the crosswise dimension by the total number of the Ni-based intermetallic compound grains seen in all of the ten photographs, the average values of each of the lengthwise dimension and the crosswise dimension of the Ni-based intermetallic compound grains were calculated. By adding the respective average values of the lengthwise dimension and the crosswise dimension, which are calculated finally, and dividing the sum by two, the grain size of the Ni-based intermetallic compound grains was determined. As a result, the grain size of the Ni-based intermetallic compound grains was 1.5 μm.

Furthermore, the proportion of the number of the Ni-M intermetallic compound grains in the total number of the Ni-based intermetallic compound grains formed in this copper alloy was determined according to the following procedure. Firstly, a cross section of the copper alloy was polished and then etched to allow a cross-sectional structure to appear. For each of arbitrarily selected five points in the cross section, a photograph was taken at a magnification of 1000 times and elemental analysis was performed by SEM-EDX (Energy Dispersive X-ray spectroscopy). In a region of a diameter of 60 mm (area 2826 $mm^2$) on each of the photographs and element mapping images thus obtained, the number of the Ni-based intermetallic compound grains (including the Ni-M intermetallic compound grains) interspersed in crystal grain boundaries and crystal grains and the number of the Ni-M intermetallic compound grains interspersed in crystal grain boundaries and crystal grains were measured. On that occasion, only the grains having a grain size of 0.1 μm or larger were counted as the Ni-based intermetallic compound grains (including the Ni-M intermetallic compound grains). By dividing the number of the Ni-M intermetallic compound grains by the number of the Ni-based intermetallic compound grains and multiplying the quotient by 100, the proportion (%) of the number of the Ni-M intermetallic compound grains to the number of the Ni-based intermetallic compound grains was calculated. The proportions of the number of the Ni-M intermetallic compound grains to the number of the Ni-based intermetallic compound grains in respective photographs and element mapping images of the five points were 7.5%, 4.6%, 6.4%, 5.8%, and 13.6%, and the average value of these was 7.58%.

<Friction and Wear Test>

Figure 2A:
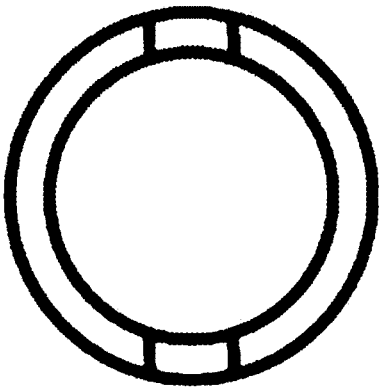
FIG. 2A is a schematic plan view illustrating a ring-shaped mating material used in a friction and wear test for a copper alloy.
Figure 2B:
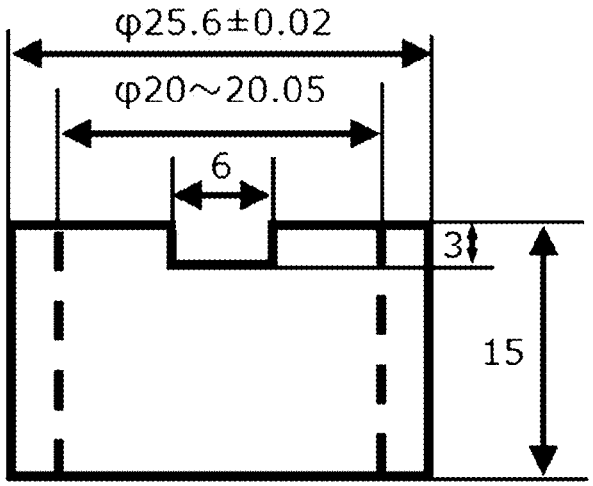
FIG. 2B is a schematic front view illustrating a ring-shaped mating material used in a friction and wear test for a copper alloy.
Figure 3:
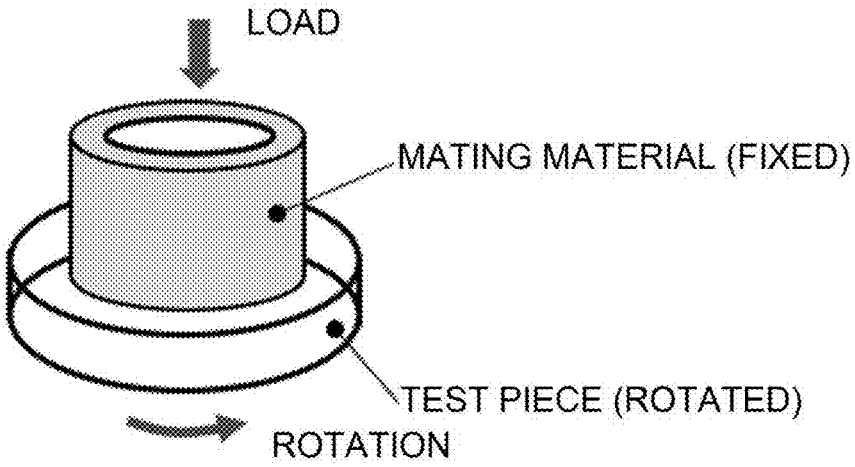
FIG. 3 is a conceptual diagram for describing a ring-on-disk test, which is a friction and wear test method for a copper alloy.

The wear resistance of the copper alloy was evaluated by conducting a test of the copper alloy obtained in (5) in the following manner. This copper alloy was machined into a test piece (square plate) having a shape whose sides and thickness are 30 mm and 1.0 to 5.0 mm, respectively. Further, a steel material (ring) having a shape as shown in FIGS. 2A and 2B was used as a mating material for the copper alloy (the numerical values in FIG. 2B are expressed in units of mm). As shown in FIG. 3, a ring-on-disk test was conducted at room temperature (25° C.) with a friction and wear tester EFM-3-H (manufactured by A&D Company, Limited) using the test piece and the mating material. The wear resistance was evaluated from the wear amount and the friction coefficient of the test piece, which were obtained by this test. Details on the test condition and the test method on that occasion are described below.

(Test Condition)

Load: 40 N

Sliding speed: 3 m/s

Test piece dimensions: 30 mm×30 mm

Surface roughness of test piece and mating material: Ra 0.4 μm or less

Material quality of mating material: bearing steel (JIS G 4805: SUJ2), HRC 60 or more (Test Method)

In a state where the test piece and the mating material were brought into contact with each other at their sliding surfaces as shown in FIG. 3, the fixed mating material was pressurized with a load of 40 N, and the test piece was rotated for 30 minutes. The test piece was rotated and slid with a set load and at a set sliding speed to detect the shear force as friction force, thereby calculating the friction coefficient. Further, the mass of the test piece was measured before the test and after the test to calculate the wear amount (mg). It can be said that when the friction coefficient is smaller and the wear amount is smaller, the wear resistance is better.

As a result of the test, the wear amount of the test piece was 3.6 mg, and the friction coefficient was 0.30. The surface of the test piece after the test was observed to find that the arithmetic average roughness Ra, measured in accordance with JIS B0601-2001, was 1.32 μm, and the ten-point average roughness Rzjis, measured in accordance with JIS B0601-2001, was 8.21 μm. The particle size of the wear powder derived from the test was 200 μm.

Example 2

A copper alloy was prepared and evaluated in the same manner as in Example 1, except that the intermediate product was held at 565° C. for 6 hours by the heat treatment to form the Ni-based intermetallic compound grains in the intermediate product in the step of performing the thermo-mechanical treatment of (3).

Figure 4:
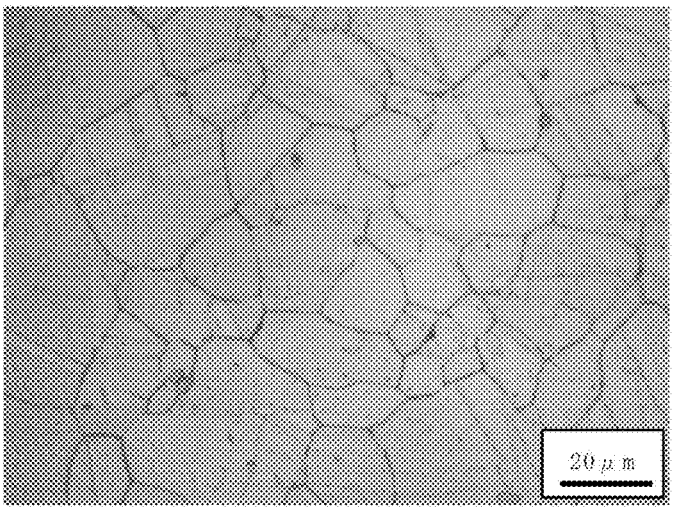
FIG. 4 is an electron microscope observation image of a cross section of a copper alloy obtained in Example 2.

As a result of cross-section observation, it was found that the Ni-based intermetallic compound grains were formed in FIG. 4. Further, the grain size of the Ni-based intermetallic compound grains was 1.0 μm, and the number of the Ni-based intermetallic compound grains present per unit area of 1 $mm^2$ in the copper alloy was $1.0\times10^4$. In the photographs and element mapping images of the five points, which were obtained by SEM-EDX, the proportions of the number of the Ni-M intermetallic compound grains to the number of the Ni-based intermetallic compound grains were 17.9%, 19.3%, 14.5%, 11.5%, and 13.4%, and the average value of these was 15.32%. As a result of the friction and wear test, the wear amount of the test piece was 6.8 mg, and the friction coefficient was 0.32. The surface of the test piece after the test was observed to find that the arithmetic average roughness Ra, measured in accordance with JIS B0601-2001, was 1.47 μm, and the ten-point average roughness Rzjis, measured in accordance with JIS B0601-2001, was 9.84 μm. The particle size of the wear powder derived from the test piece was 450 μm.

Example 3

A copper alloy was prepared and evaluated in the same manner as in Example 1, except that a raw material alloy having a composition composed of Ni: 10.6% by weight, Sn: 5.5% by weight, Si: 0.45% by weight, Mn: 0.37% by weight, the balance being Cu and inevitable impurities (that is, a raw material alloy obtained by adding only Si as the element M) was used as the raw material alloy of (1).

As a result of cross-section observation, it was found that the Ni-based intermetallic compound grains were formed. Further, the grain size of the Ni-based intermetallic compound grains was 10 μm, and the number of the Ni-based intermetallic compound grains present per unit area of 1 $mm^2$ in the copper alloy was $1.0\times10^8$. In the photographs and element mapping images of the five points, which were obtained by SEM-EDX, the proportions of the number of the Ni-M intermetallic compound grains to the number of the Ni-based intermetallic compound grains were 5.2%, 10.2%, 6.6%, 3.8%, and 3.7%, and the average value of these was 5.90%. As a result of the friction and wear test, the wear amount of the test piece was 0.7 mg, and the friction coefficient was 0.32. The surface of the test piece after the test was observed to find that the arithmetic average roughness Ra, measured in accordance with JIS B0601-2001, was 0.92 μm, and the ten-point average roughness Rzjis, measured in accordance with JIS B0601-2001, was 5.49 μm. The particle size of the wear powder derived from the test piece was 300 μm.

Example 4

A copper alloy was prepared and evaluated in the same manner as in Example 1, except that a raw material alloy having a composition composed of Ni: 10.5% by weight, Sn: 5.4% by weight, Fe: 1.38% by weight, Si: 0.02% by weight, Mn: 0.18% by weight, the balance being Cu and inevitable impurities (that is, a raw material alloy obtained by adding Fe and Si as the element M) was used as the raw material alloy of (1).

As a result of cross-section observation, it was found that the Ni-based intermetallic compound grains were formed. Further, the grain size of the Ni-based intermetallic compound grains was 1.0 μm, and the number of the Ni-based intermetallic compound grains present per unit area of 1 $mm^2$ in the copper alloy was $2.0\times10^3$. As a result of the friction and wear test, the wear amount of the test piece was 3.9 mg, and the friction coefficient was 0.38. The surface of the test piece after the test was observed to find that the arithmetic average roughness Ra, measured in accordance with JIS B0601-2001, was 1.47 μm, and the ten-point average roughness Rzjis, measured in accordance with JIS B0601-2001, was 8.71 μm. The particle size of the wear powder derived from the test piece was 400 μm.

Example 5

A copper alloy was prepared and evaluated in the same manner as in Example 1, except that a raw material alloy having a composition composed of Ni: 10.6% by weight, Sn: 5.4% by weight, Ti: 0.75% by weight, Si: 0.07% by weight, Mn: 0.41% by weight, the balance being Cu and inevitable impurities (that is, a raw material alloy obtained by adding Ti and Si as the element M) was used as the raw material alloy of (1).

As a result of cross-section observation, it was found that the Ni-based intermetallic compound grains were formed. Further, the grain size of the Ni-based intermetallic compound grains was 25 μm, and the number of the Ni-based intermetallic compound grains present per unit area of 1 $mm^2$ in the copper alloy was $2.0\times10^3$. As a result of the friction and wear test, the wear amount of the test piece was 5.0 mg, and the friction coefficient was 0.40. The surface of the test piece after the test was observed to find that the arithmetic average roughness Ra, measured in accordance with JIS B0601-2001, was 1.41 μm, and the ten-point average roughness Rzjis, measured in accordance with JIS B0601-2001, was 6.94 μm. The particle size of the wear powder derived from the test piece was 200 μm.

Example 6

A copper alloy was prepared and evaluated in the same manner as in Example 1, except that a raw material alloy having a composition composed of Ni: 20.0 to 22.0% by weight, Sn: 4.5 to 5.7% by weight, Zr: 0.21% by weight, Mn: 0.34% by weight, the balance being Cu and inevitable impurities was used as the raw material alloy of (1).

Figure 5:
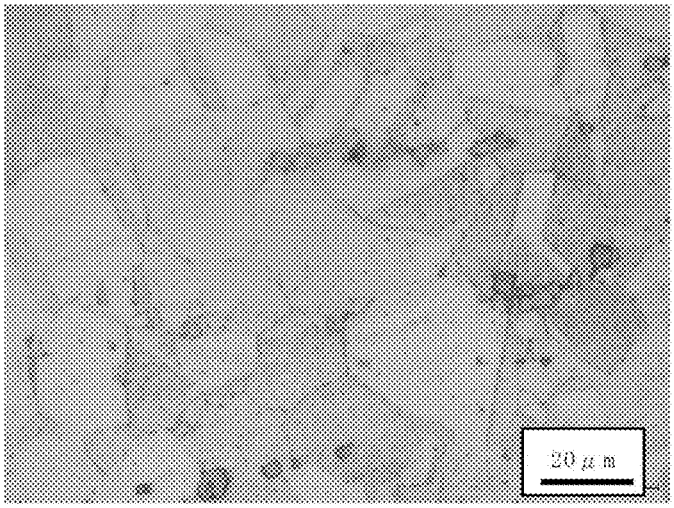
FIG. 5 is an electron microscope observation image of a cross section of a copper alloy obtained in Example 6.

As a result of cross-section observation, it was found that the Ni-based intermetallic compound grains were formed in FIG. 5. Further, the grain size of the Ni-based intermetallic compound grains was 3.0 μm, and the number of the Ni-based intermetallic compound grains present per unit area of 1 $mm^2$ in the copper alloy was $5.0\times10^3$. In the photographs and element mapping images of the five points, which were obtained by SEM-EDX, the proportions of the number of the Ni-M intermetallic compound grains to the number of the Ni-based intermetallic compound grains were 6.9%, 14.1%, 5.7%, 4.3%, and 15.8%, and the average value of these was 9.36%. As a result of the friction and wear test, the wear amount of the test piece was 6.8 mg, and the friction coefficient was 0.33. The surface of the test piece after the test was observed to find that the arithmetic average roughness Ra, measured in accordance with JIS B0601-2001, was 0.53 μm, and the ten-point average roughness Rzjis, measured in accordance with JIS B0601-2001, was 5.24 μm. The particle size of the wear powder derived from the test piece was 100 μm.

Example 7 (Comparison)

A copper alloy was prepared and evaluated in the same manner as in Example 1, except that a raw material alloy having a composition composed of Ni: 9.14% by weight, Sn: 6.18% by weight, Zr: 0.10% by weight, Mn: 0.33% by weight, the balance being Cu and inevitable impurities was used as the raw material alloy of (1) and that a solution annealing and an aging treatment were performed in the following manner without performing (2) to (5).

(Solution Annealing and Aging Treatment)

A solution heat treatment (a treatment of performing water cooling after holding the ingot at 800 to 900° C. for 2 to 8 hours) and an aging heat treatment (a treatment of performing air cooling after holding the ingot at 300 to 400° C. for 0.5 to 4 hours) were performed on the ingot obtained in (1) to thereby obtain a copper alloy. That is, the step of subjecting the ingot to hot working or cold working to make an intermediate product in (2), the steps other than the solutionization in (3), and the step of performing finish rolling of (4) were not performed.

Figure 6:
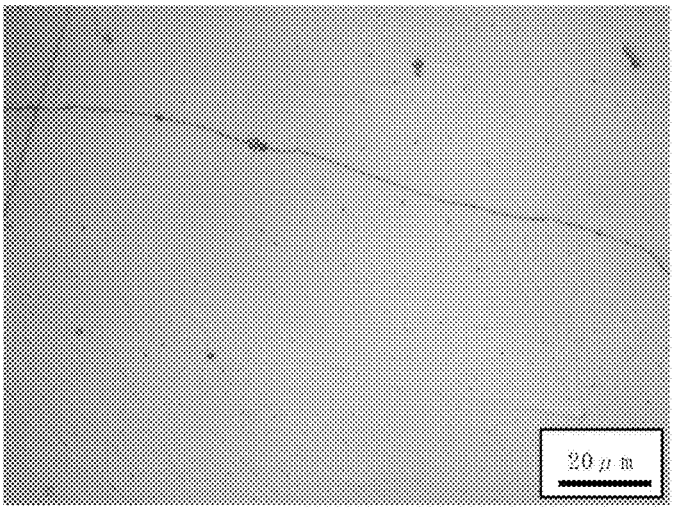
FIG. 6 is an electron microscope observation image of a cross section of a copper alloy obtained in Example 7.

As a result of cross-section observation, it was found that the Ni-based intermetallic compound grains were formed in FIG. 6. Further, the grain size of the Ni-based intermetallic compound grains was 2.0 μm, and the number of the Ni-based intermetallic compound grains present per unit area of 1 $mm^2$ in the copper alloy was $8.0\times10^2$. As a result of the friction and wear test, the wear amount of the test piece was 6.8 mg, and the friction coefficient was 0.53. The surface of the test piece after the test was observed to find that the arithmetic average roughness Ra, measured in accordance with JIS B0601-2001, was 4.04 μm, and the ten-point average roughness Rzjis, measured in accordance with JIS B0601-2001, was 18.2 μm. The particle size of the wear powder derived from the test piece was 500 μm.

Example 8 (Comparison)

A copper alloy was prepared and evaluated in the same manner as in Example 1, except that a raw material alloy having a composition composed of Ni: 8.5 to 9.5% by weight, Sn: 5.5 to 6.5% by weight, Mn: 0.35% by weight, the balance being Cu and inevitable impurities (that is, a raw material alloy in which the element M was not added) was used as the raw material alloy of (1) and that the thermo-mechanical treatment of (3) was not performed.

Figure 7:
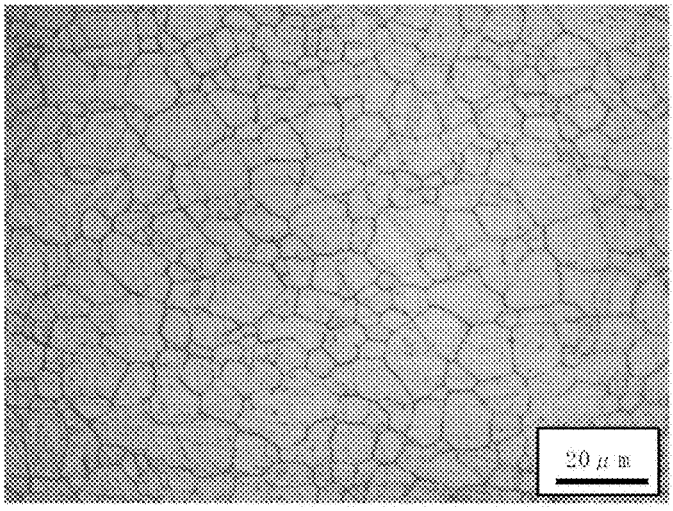
FIG. 7 is an electron microscope observation image of a cross section of a copper alloy obtained in Example 8.

As a result of cross-section observation, it was found that the Ni-based intermetallic compound grains were not formed in FIG. 7. As a result of the friction and wear test, the wear amount of the test piece was 6.8 mg, and the friction coefficient was 0.46. The surface of the test piece after the test was observed to find that the arithmetic average roughness Ra, measured in accordance with JIS B0601-2001, was 2.86 μm, and the ten-point average roughness Rzjis, measured in accordance with JIS B0601-2001, was 16.22 μm. The particle size of the wear powder derived from the test piece was 500 μm.

Example 9

A copper alloy was prepared and evaluated in the same manner as in Example 1, except that a raw material alloy having a composition composed of Ni: 20.0 to 22.0% by weight, Sn: 4.5 to 5.5% by weight, Zr: 0.16% by weight, Mn: 0.35% by weight, the balance being Cu and inevitable impurities was used as the raw material alloy of (1).

As a result of cross-section observation, it was found that the Ni-based intermetallic compound grains were formed. Further, the grain size of the Ni-based intermetallic compound grains was 4.8 μm, and the number of the Ni-based intermetallic compound grains present per unit area of 1 $mm^2$ in the copper alloy was $1.66\times10^3$. In the photographs and element mapping images of the five points, which were obtained by SEM-EDX, the proportions of the number of the Ni-M intermetallic compound grains to the number of the Ni-based intermetallic compound grains were 4.3%, 7.1%, 7.4%, 7.8%, and 8.1%, and the average value of these was 6.94%. As a result of the friction and wear test, the wear amount of the test piece was 3.3 mg, and the friction coefficient was 0.25. The surface of the test piece after the test was observed to find that the arithmetic average roughness Ra, measured in accordance with JIS B0601-2001, was 1.21 μm, and the ten-point average roughness Rzjis, measured in accordance with JIS B0601-2001, was 7.54 μm. The particle size of the wear powder derived from the test piece was 37 μm.

What is claimed is:

1. A copper alloy composed of:

Ni: 5 to 25% by weight;

Sn: 5 to 10% by weight;

at least one element M selected from the group consisting of Zr, Ti, Fe, and Si: 0.01 to 0.30% by weight in total;

at least one element A selected from the group consisting of Mn, Zn, Mg, Ca, Al, and P: 0.01 to 1.00% by weight in total;

the balance being Cu and inevitable impurities, wherein Ni-based intermetallic compound grains comprising a Ni-M intermetallic compound are formed in the copper alloy, and a number of the Ni-based intermetallic compound grains present per unit area of 1 $mm^2$ in the copper alloy is $1.0\times10^3$ to $2.0\times10^4$, wherein the number of the Ni-based intermetallic compound grains present per unit area of 1 $mm^2$ is determined using only Ni-based intermetallic compound grains having a grain size of 1.5 to 100 μm, and wherein the copper alloy has a friction coefficient of 0.4 or less.

2. The copper alloy according to claim 1, wherein the element M is Zr.

3. The copper alloy according to claim 1, wherein the element A is Mn.

4. The copper alloy according to claim 1, wherein a total content of the element A is 0.10 to 0.40% by weight.

5. The copper alloy according to claim 1, wherein a proportion of the number of the Ni-M intermetallic compound grains having a grain size of 0.1 μm or larger in the total number of the Ni-based intermetallic compound grains having a grain size of 0.1 μm or larger is 1.0 to 30%.

6. A method for producing the copper alloy according to claim 1, the method comprising:

melting and casting a raw material alloy to make an ingot, the raw material alloy being composed of:

Ni: 5 to 25% by weight;

Sn: 5 to 10% by weight;

at least one element M selected from the group consisting of Zr, Ti, Fe, and Si: 0.01 to 0.30% by weight in total; and at least one element A selected from the group consisting of Mn, Zn, Mg, Ca, Al, and P: 0.01 to 1.00% by weight in total;

the balance being Cu and inevitable impurities, subjecting the ingot to hot working or cold working to make an intermediate product, performing i) a heat treatment, ii) hot working or cold working, and iii) solutionization on the intermediate product in this order, thereby performing a thermomechanical treatment, and subjecting the intermediate product after the thermomechanical treatment to an aging treatment to obtain the copper alloy.

7. The method for producing a copper alloy according to claim 6, wherein the heat treatment is performed by holding the intermediate product at 500 to 950° C. for 2 to 24 hours.

8. The method for producing a copper alloy according to claim 6, wherein the solutionization is performed by holding the intermediate product at 700 to 1000° C. for 5 seconds to 24 hours.

9. The method for producing the copper alloy according to claim 6, further comprising subjecting the intermediate product to finish hot working or finish cold working after the thermomechanical treatment and before the aging treatment.

* * * * *